United States Patent [19]

Beeh

[11] Patent Number: 4,799,278

[45] Date of Patent: Jan. 24, 1989

[54] MACHINE AND A METHOD FOR DYEING FABRICS WITH ALREADY KNOWN DYESTUFFS

[76] Inventor: Hans A. Beeh, Don Orione 568, Victoria (1644), Argentina

[21] Appl. No.: 62,455

[22] Filed: Jun. 12, 1987

[51] Int. Cl.[4] ..... D06B 3/12; D06B 21/00; D06B 23/00

[52] U.S. Cl. ..... 8/151; 68/5 D; 68/9; 68/175

[58] Field of Search ..... 68/5 D, 5 E, 9, 175; 8/477, 149.1, 151

[56] References Cited

U.S. PATENT DOCUMENTS 2,826,479 3/1958 Cole ..... 8/151 X
3,529,447 9/1970 Fleissner et al. ..... 68/9 X
4,397,650 8/1983 Gregorian et al. ..... 8/477
4,416,124 11/1983 Godau ..... 68/9
4,501,037 2/1985 Lay et al. ..... 68/5 D X

FOREIGN PATENT DOCUMENTS 2089245 6/1982 United Kingdom ..... 68/5 D

*Primary Examiner*—Philip R. Coe
*Attorney, Agent, or Firm*—McGlew and Tuttle

[57] ABSTRACT

A machine and a method for dyeing fabrics with known dyestuffs in which the fabric has its ends sewn to a leader and forms an endless loop that continually passes through a scray and dyeing stations such as a padder, a foam applicator, a steamer, and a washbox, with the dyestuff of the stations being replaceable during the passing of the leader with which substantially small fabric dyelots may be dyed in a continuous machine that can process variable length lots.

7 Claims, 1 Drawing Sheet

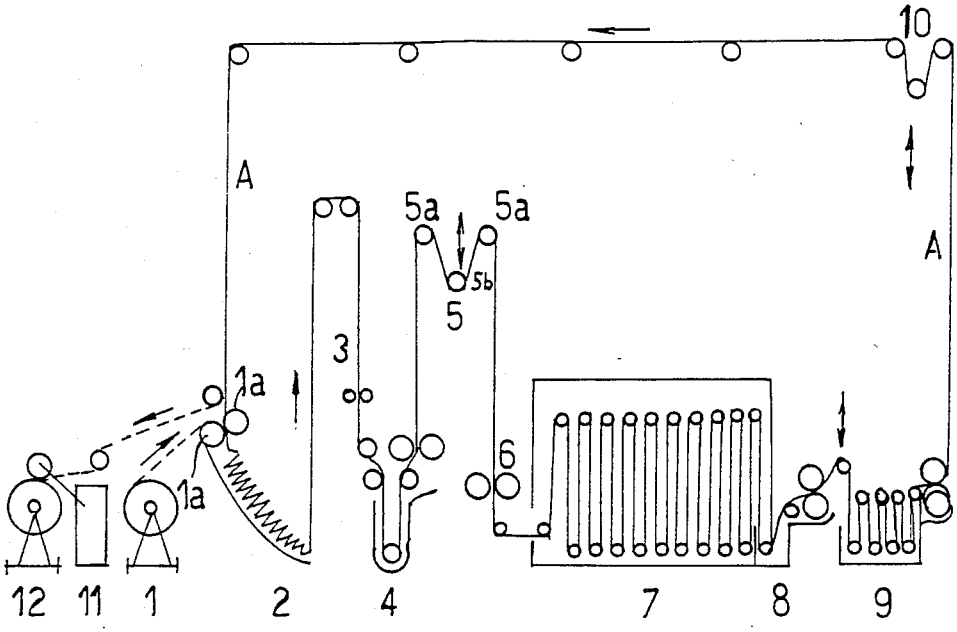
10
A
A
5a
5a
5b
5
3
1a
1a
6
12
11
1
2
4
7
8
9

MACHINE AND A METHOD FOR DYEING FABRICS WITH ALREADY KNOWN DYESTUFFS

FIELD OF THE INVENTION

The invention relates to a method for dyeing fabrics on a specially designed machine enabling to produce economically short dyelots.

DESCRIPTION OF PRIOR ART

The coloration of textiles is an old art, through which both the esthetical and commercial value of the substrate is bettered.

Dyestuffs were and still are mainly applied from a dyebath through physical contact. The color obtained depends principally on the characteristics of the dyestuff, its concentration in the dyebath, the ratio dyebath-/substrate, the temperature and the time of contact. Uniformity of color depends on uniformity of process parameters over the whole extension of the fabric.

To assure uniformity two basic procedures are used: move the fabric through a stationary dyebath, or circulate the dyebath through a stationary fabric.

Manual dyeing procedures have been replaced by machines. Until the 1940's most machines were designed to dye short lots in batch operations, both with stationary dyebath: jigs, dye-becks, and stationary fabric: beam-dyeing-machines.

During World War II the Dupont company developed a continuous dyeing machine and process, called pad-steam, to produce economically large quantities of fabrics for uniforms. Cost compares to batch processes and is substantially lower. Several years later, after the appearance of polyester/cotton blends, the same Company invented the Thermosol process. This process, combined with the pad-stem process, makes it possible to dye simultaneously both fibers.

The methods (pad-steam, thermosol) are performed on very long machines, in which the fabric is carried successively through different steps, required to perform the dyeing. Such as:

1: padder, in which dyebath is applied uniformly;
2: pre-dryer, usually infrared, in which water is evenly evaporated;
3: dryer, usually drying cans, in which water is completely evaporated;
4: padder, in which chemicals necessary to achieve dye fixation are applied;
5: steamer, in which said fixation is accelerated;
6: washing compartments (from 8 to 12), in which excess unfixed dyes are washed off.

Machines for dyeing of polyester/cotton blends include a high temperature oven between steps 3 and 4, in which disperse dyestuffs are made to diffuse into the polyester fiber by heat.

To dye fabrics with Indigo (the product denomination is China-blue) known Indigo yarn dyeing machines are temporarily converted to operate with fabrics these machines, specially built for Indigo dyeing, are very highly priced.

Due to the size of said machines both set up times and waste of dyestuffs and chemicals during changeovers are considerable. For this reason lower running costs on continuous ranges are offset by changeover costs when dyeing relatively short runs.

Until the sixties and seventies many continuous dyeing ranges have been installed, as long dyelots were quite common. Thus important savings against batch dyeing in dyestuffs, chemicals, water, energy and labor were achieved. During the last decade the market demand switched to a greater diversity in colors and styles, thus reducing lot size. For this reason batch dyeing machines have again been used and improved extensively.

The liquor ratio has been reduced. The liquor ratio is the relation between dyebath and substrate. The higher the ratio the lower the dyestuff yield. In machines with stationary dyebath, fabric capacities and speeds have been increased. In machines with stationary fabric, flow rate and also capacity of fabric have been improved. Most of new machines are extensively automated, to assure accuracy in the dyeings.

Also continuous dyeing ranges have been cut down in size and automated in order to reduce the costs of changeover. For a group of dyestuffs (fiber reactive) a semi-continuous method has evolved called Pad-batch. By this method the fabric is impregnated with dyestuff and alkali solution in a padder, wound on beams, covered with plastic film (to prevent uneven dryeing), and left rotating (to prevent bath from concentrating in the bottom of the roll) for several hours, after which dyestuff-fiber reaction is completed. Thereafter the fabricx has to be washed on conventional washing ranges or by water being pumped through the perforated beam, thereby collating through the rotating fabric roll.

ADVANTAGES OF THE INVENTION

The present invention makes it possible to dye economically small lots of fabrics.

Former methods required either:

Highly priced continuous dyeing ranges. On these machines large lots can be dyed at very low unitary costs. But due to high set up costs short runs are not economical.

Batch dyeing machines. Unitary costs are sensibly higher than on continuous machines. Color uniformity from lot to lot is difficult to achieve.

Downscaled continuous ranges. Prices and set up costs are still relatively high. Several passages are normally required to complete the process, thereby increasing fabric stocks and the risk of undetected faults.

Semicontinuous methods. Low investment, but restricted to one dyestuff group. Time to complete the process is considerable, thereby increasing risk.

The advantages of this invention are:

Low price machine,

High process flexibility. Many known fibers can be dyed with most known dyestuffs.

Low cost. Running costs are similar to those of conventional continuous ranges. Set up costs and times are very low.

The method of this invention comprises running the fabric several times continuously through the machine, thereby completing the process in a short time, preventing the build up of fabric stocks and reducing the risk of undetected faults in process stock.

SUMMARY OF THE INVENTION

An object of this invention is to make the dyeing of small lots as cost efficient as the dyeing of large lots on known continuous dyeing ranges, such as those used to perform the pad-steam and pad-thermosol-steam processes.

To this effect this new machine has been developed. The machine of the invention is made up from well known parts put together in a novel way. The process developed for this machine uses some known unitary operations combined in such a way as to produce a very low cost operation.

Basically the method comprises the following steps:

1: Entering the dyelot from the fabric batch into the scray.

2: Sewing together the ends of the lot with the ends of the leader (already in the machine) in such a way as to obtain an endless sheet of fabric.

3: Feeding of:
dyebath into the padder,
chemcials into the foam applicator,
steam into the steamer,
water into waterseal and washbox.

4: Starting the fabric to run through the machine, feeding each part of it in such a way as to maintain the selected process conditions.

5: When the leader reaches the padder again, process conditions are switched for the second passage, such as:
padder is emptied and rinsed,
chemicals in foam applicator are replaced by after treatment products,
steamer is flooded with water,
waterseal and washbox continue being fed with water.

6: After completing step 5 coincidently with the end of the leader running through the padder, the second and last passage begins. The head of the lot is not fed into the scray. Instead, after cutting it off from the end of the leader, the lot is batched with a device as it exits from the machine.

The method as described previously is adequate for most dyeings. When dark shades are processed, a third passage (additional washing) will improve the fastness properties of the goods.

For dyeing fabrics with Indigo two to five dyeing passages will be necessary to achieve shades from medium to dark blue. Steaming will be replaced in this case by skyeing (oxidation by air). Two washing passages are needed for the darker shades.

A conventional dyestuff and chemical dissolving and preparation station is required to properly feed the dyeing machine with dyebath and chemicals.

BRIEF DESCRIPTION OF THE DRAWING

FIG. 1 is a schematic side elevational view of a preferred embodiment of the machine of the invention.

DETAILED DESCRIPTION OF THE INVENTION

As shown in FIG. 1 the fabric bath 1 to be fed into the machine is rolled in a device suitable to carry it.

In the drawing of FIG. 1 the fabric is represented by continuous line A with arrows showing the travelling sense, except when represented by dotted lines, that means that this path is followed only at the beginning and ending of the dyeing operation.

The fabric is unwound from the device and is sewed to a leader that is already threaded in the machine and guides the fabric, which is then passed through a pair of rollers 1*a* that feeds it to a fabric accumulator 2 that is also frequently called scray or J-box and in which a predetermined amount of fabric is accumulated, the end of which is sewed to the leading edge of the leader.

After passing through the fabric guider 3, consisting of several rollers preferably placed as shown, the fabric goes into a padder 4, also frequently called foulard, which is well known in the art and is a trough containing the chemical that is applied to the fabric with padding rollers in its exit end.

The next step is carried on in dancing roll 5, consisting in two fixed rollers 5*a* and an intermediate roller 5*b* having a free vertical displacement, step in which a regular feeding speed is attained.

Afterwards the fabric passes through foam applicator 6 before going into the steamer 7 consisting in several parallel rollers placed in a substantially closed chamber into which steam is injected or may also flooded with water, the fabric going through the chamber guided by the rollers.

At the outgoing end of the chamber there is a waterseal 8.

After passing through the waterseal 8 the fabric goes over a tightness control roller that is vertically movable and then into a washbox 9 that is a trough full of washing solution with several rollers therein compelling the fabric to go into the solution several times during the passage through the washbox.

When the fabric leaves washbox 9 passes through a second dancing roll 10 and then goes back to the pair of rollers 1*a*, if it has not completed the dyeing process, otherwise it goes to batching device 11 that controls the fabric batch 12 exiting the machine.

Henceforth several examples are given in which different fabrics are dyed using the machine and the method of present invention.

EXAMPLE 1

Substrate: 100% cotton percale, previously desized, bleached and mercerized, width 2.30 m, weight 160 g/m2.

Dyelot: 800 m=294 kg.

Color: Vat dyestuff, light shade.

Sequence of steps:

| step | operation | pad | foam | steam | seal | wash | speed m/min | time min |
|---|---|---|---|---|---|---|---|---|
| 0 | set up (a) | | | | | | | 10 |
| 1 | dyeing | (b) | (c) | 100° C. | 20° C. | 20° C. | 50 | 18 |
| 2 | after treatment | | (d) | 100° C. | 60° C. | 60° C. | 70 total | 13 41 |

Notes:
(a) Set up time consists of
feeding of the dyelot into the scray 2 ;
sewing both ends to the leader, forming a fabric ring;
separating the dyelot from the leader after completion of the process;
exiting the lot from the machine;
- intermediate rinsing and cleaning.
In most instances feeding in of the new dyelot can be performed coincidentally with the last step and exit of the previous lot. Therefore only the sewing together, cutting off and cleaning operations are considered as set up times. Cleaning is kept to a minimum by proper dyecycle selection.
(b) Dyebath is fed into the padder through 4 during the passage of the leader and kept automatically at constant level. Temperature is set at 50° C. Bath composition is similar to that required for the normal continuous process, except that antimigration agents are not included, as no
drying is performed, thereby achieving savings both in chemicals and energy.
(c) Intermediate drying and chemical pad used at this stage in padsteam ranges are replaced by a 25% add-on of a sodiumhydrosulfite, sodium hydroxide, water and nitrogen foam performed with a conventional foam generator and applicator 6. Foam distribution has to be uniform on both sides of
the fabric and over the whole width. Chemical concentration has to be increased -continued three times over that used in pad-steam ranges, to compensate for the fact that three times less liquor is being applied.
Alternatively other known means of low add-on can be used, such as: kissing-rolls, booster, screen printers, etc. The steamer 7 will be run at 100° C. fed by a controlled amount of saturated steam. Washwater will be circulated in counterflow through the washbox 9 and the waterseal 8, where it will be discharged. Temperature 20°
C. Flow rate 5 1/kg.
(d) Completed step 1 the padder through 4 is emptied and rinsed and then kept empty. At the foam applicator 6 chemicals are changed to oxidizing and soaping agents. Add-on is kept at 25% liquid, including:

| | |
|---|---|
| hydrogen peroxide | 0,1% (on fabric weight) |
| anionic detergent | 0,1% |
| sodium silicate | 0,05% (rest water +air) |

Air may be used to generate the foam. Steaming conditions remain unchanged Washwater temperature is increased to 60° C. Flow rate unchanged.

EXAMPLE 2

Substrate: 100% cotton terry fabric, previously bleached, width 1.80 pk m, weight 420 g/m2.
Dyelot: 1300 m=983 kg.
Color: fiber reactive dyestuff, medium shade.

Sequence of steps:

| step | operation | pad | foam | steam | seal | wash | speed m/min | time min |
|---|---|---|---|---|---|---|---|---|
| 0 | set up | | | | | | | 10 |
| 1 | dyeing | (a) | (b) | 100° C. | 30° C. | 30° C. | 35 | 41 |
| 2 | after-treatment | — | — | (c) | 50° C. | 50° C. | 50 | 28 |
| 3 | after-treatment | — | (d) | 100° C. | 70° C. | 70° C. | 50 | 28 |
| | | | | | | | total | 107 |

Notes:
(a) Same dye formulation as for normal pad-steam range, omitting antimigration agent, as no drying has to be performed. Adjust nip pressure to obtanin 70% pick-up. Temperature 50° C.
(b) Caustic required for dye fixation is added at the foam applicator 6. Add on is 25%. Caustic concentration in liquid is three times higher as usual for same formulation in pad-steam ranges in order to compensate for lower liquor pick-up.
(c) For the second passage the steamer bottom 7 is flooded with water. Washwater is conducted counterflow from washbox 9 to steamer 7, where it is discharged. Temperature 50° C.
(d) For the third passage an anionic detergent is added at the foam applicator 6 at a rate of 0,2% (referred to fabric weight), add-on 25%. The steamer 7 is kept again at 100° C. with saturated steam. Washwater is fed at 70° C. into the washbox 9 and discharged at the waterseal 8.

EXAMPLE 3

Substrate: 100% cotton twill, greige, width 1.65 m, weight 280 g/m2.
Dyelot: 1000 m=462 kg.
Color: Indigo, dark blue.

Sequence of steps:

| step | operation | pad | foam | steam | seal | wash | speed m/min | time min |
|---|---|---|---|---|---|---|---|---|
| 1 | scouring | (a) | — | 100° C. | 60° C. | 60° C. | 80 | 14 |
| 2 | dyeing | (b) | — | (c) | — | — | 40 | 28 |
| 3 | dyeing | (b) | — | (c) | — | — | 40 | 28 |
| 4 | dyeing | (b) | — | (c) | — | — | 40 | 28 |
| 5 | dyeing | (b) | — | (c) | — | — | 40 | 28 |
| 6 | dyeing | (b) | — | (c) | — | — | 40 | 28 |
| 7 | washing | — | — | (d) | 40° C. | 40° C. | 80 | 14 |
| 8 | soaping | (e) | — | 100° C. | 60° C. | 60° C. | 80 | 14 |
| 0 | set up (f) | | | | | | | 10 |
| | | | | | | | total | 192 |

Notes:
(a) Scouring liquor containing:

| | |
|---|---|
| non ionic detergent | 2 g/l |
| sodium hydroxide | 5 g/l |

is fed into the padder 4. Temperature is maintained at 60° C. Nip pressure is adjusted in such a way as to obtain a pick-up of approximately 60%. No chemicals are applied with the foam applicator 6. Temperature inside the steamer 7 is held at 100° C. with saturated steam injection. Washwater at 60° C. is fed into the washbox 9 at a rate of 5 1 of water per kg of fabric and conducted counterflow through the washbox 9 and the waterseal 8 and then discharged.
(b) Liquor in padder 4 is replaced during the passage of the leader (120 m length) with dyebath. The initial bath is prepared by mixing in the padder trough of 4,5 1 of dye vat with 30,5 1 of water. Said Indigo dye vat is previously prepared as follows:

| | |
|---|---|
| water at 50° C. | 800 1 |
| non ionic detergent | 5 kg |
| emulsifier | 5 kg |
| sodium hydroxide | 90 kg |
| Indigo | 80 kg |
| sodium hydrosulfite | 100 kg |

Add in the given sequence, complete to 1000 1 with water, stir for 3 minutes. Reaction is completed after 30 minutes and dyevat ready for use. During fabric passage dyevat is pumped into the padder 4 with an appropriate pump at a rate of 1,016 1/min (0,44% add-on of Indigo per passage). Temperature is kept at 20° C.
(c) No steam is to be used in the steamer 7. Instead air is circulated by means of a fan and ducts, in order to increase the speed of Indigo oxida- by air. A flow rate of 100 m3 per minute at room temerature is adequate. No foam is applied, no water is circulated through seal 8 or washbox 9.
(d) After completing step 6) the padder 4 is emptied, the steamer bottom 7 flooded with water. Then washwater is fed at 40° C. into the washbox 9 and conducted counterflow through the seal 8 and steamer 7 and then discharged. Flow rate 5 1/kg.
(e) Completed step 7) the steamer 7 is emptied and fed with steam. A soaping agent (anionic detergent) is fed into the padder 4 at a rate of 0,2% to the weight of the fabric. Water at 60° C. is counterflowed through the washbox 9 and seal 8.
(f) Set up operations as in example 1. Total time 192 minutes.

EXAMPLE 4

Substrate: 67/33% polyester/cotton fabric, previously desized, scoured and mercerized, later impregnated with disperse dyestuffs in a padder, dried and thermosoled. Width 1.60 m, weight 210 g/m2.
Dyelot: 3500 m=1176 kg.
Color: Sulphur dyestuff, dark shade.

Sequence of steps:

| step | operation | pad | foam | steam | seal | wash | speed m/min | time min |
|---|---|---|---|---|---|---|---|---|
| 0 | set up | | | | | | | 10 |
| 1 | dyeing | (a) | — | 100° C. | 40° C. | 40° C. | 50 | 72 |
| 2 | washing | — | — | (b) | 50° C. | 50° C. | 80 | 45 |
| 3 | oxidation, soaping | — | (c) | 95° C. | 50° C. | 50° C. | 80 | 45 |
| | | | | | | | total | 172 |

Notes:
(a) Impregnation in padder 4 with prereduced sulphur dyestuffs: concentration same as in fullsized dyeing ranges.

| | |
|---|---|
| sulphur dyestuff (liquid) | 100–200 g/l |
| anionic wetting agent | 3 g/l |
| sodium polysulphide | 30–20 g/l |

(b) Steamer 7 is flooded and washwater conducted counterflow from washbox 9 through seal through and steamer 7, where it exits.
(c) Foam applied contains (referred to fabric weigth):

-continued

| | |
|---|---|
| potassium bichromate | 0,2% |
| acetic acid | 0,1% |
| anionic detergent | 0,2% |

Steamer 7 remains flooded, washwater is counterflowed from wash-box 9 to steamer exit.

What I claim is:

1. An apparatus for dyeing fabrics in dyelots comprising a fabric accumulator, a fabric guider adjacent to said fabric accumulator, a fabric padder comprising a trough containing a chemical that is applied to the fabric adjacent to said fabric guider, a dancing roll system adjacent said padder, foam applicator means adjacent said dancing roll system, a steamer adjacent to said foam applicator and having an exit end with at least one water seal, tightness control means at said exit end, a wash box associated with said tightness control means, fabric guide means passing through said fabric accumulator, a supply of fabric to be dyed and means for securing said fabric to said guide means in order to obtain an endless sheet-form loop comprising the fabric and said guide means, capable of being passed repeatedly through said fabric guider, said padder, said dancing roll system, said foam applicator, said steamer, said water seal, and said wash box, in succession one after the other without stopping, the padder being adapted to be emptied or for chemical replacement while the fabric guide means is passing therethrough between successive passages of a dyelot.

2. An apparatus for dyeing fabrics in dyelots in which dyeing stages are performed during the passage of a fabric dyelot along a treatment path through treatment stations, the fabric dyelot having its ends secured to a leader to obtain an endless sheet-form loop capable of continuous translational movement in the same direction through the stations, the apparatus comprising a fabric accumulator from which the fabric is continuously fed in the same direction repeatedly through said treatment stations; said treatment stations comprising a single padder trough containing dyestuff which can be replaced or emptied during the passage of the leader therethrough, a foam applicator, a steamer and a wash box placed in the treatment path and arranged in succession one after the other.

3. An apparatus machine for dyeing fabrics in dyelots comprising: a fabric accumulator; a series of fabric treatment stations including a padder for dyestuff and dye fixing means arranged in succession along a treatment path; and, a leader secured to respective opposite ends of a fabric dyelot to form therewith an endless sheet-form loop which is continuously fed from the accumulator along a treatment path extending through the treatment stations successively with the dyelot passing in the same direction through each treatment station repeatedly without stopping, at least one of said treatment stations being able to be altered in operational condition for successive passes of the dyelot during the passage of the leader therethrough.

4. An apparatus according to claim 3, wherein the operational condition of the padder can be altered by replacement or removal of the dyestuff during a passage of the leader therethrough.

5. An apparatus according to claim 4 wherein the padder comprises only a single padder trough, the dye fixing means comprises a foam applicator, and the treatment stations further comprise a steamer and a wash box arranged in succession after the padder along the treatment path.

6. A process for dyeing fabrics in which a fabric dyelot is passed from an accumulator along a treatment path extending through successive treatment stations including a padder for dyestuff and dye fixing means arranged in succession which process comprises the steps of: securing opposite ends of the dyelot to a leader to obtain an endless sheet-form loop; feeding the loop continuously in the same direction through successive treatment stations repeatedly without stopping and, altering the operational condition of at least one of the stations for successive passes of the dyelot therethrough during the passage of the leader through the one station.

7. A process according to claim 6 wherein the operational condition of the padder is altered by replacement or removal of the dyestuff during the passage of the leader through the padder.

* * * * *